US006719048B1

(12) United States Patent
Ramos et al.

(10) Patent No.: US 6,719,048 B1
(45) Date of Patent: Apr. 13, 2004

(54) SEPARATION OF OIL-WELL FLUID MIXTURES

(75) Inventors: Rogerio Tadeu Ramos, Brookfield, CT (US); Bernard Elie Theron, Igny (FR); Andrew J. Reischer, Ridgefield, CT (US); William F. Murphy, Redding, CT (US); Ian David Bryant, Ridgefield, CT (US); David J. Wilkinson, Ridgefield, CT (US)

(73) Assignee: Schlumberger Technology Corporation, Ridgefield, CT (US)

( * ) Notice: Subject to any disclaimer, the term of this patent is extended or adjusted under 35 U.S.C. 154(b) by 0 days.

(21) Appl. No.: 09/106,608

(22) Filed: Jun. 29, 1998

(30) Foreign Application Priority Data

Jul. 3, 1997 (GB) ..... 9713960

(51) Int. Cl.[7] ..... E21B 43/40; E21B 43/38
(52) U.S. Cl. ..... 166/250.15; 166/265
(58) Field of Search ..... 166/50, 265, 250.15, 166/250.02, 313, 105, 106; 210/96.1, 521, 522, 739, 800

(56) References Cited

U.S. PATENT DOCUMENTS

| | | | | |
|---|---|---|---|---|
| 5,296,153 A | | 3/1994 | Peachey | 210/787 |
| 5,443,120 A | | 8/1995 | Howell | 166/265 |
| 5,456,837 A | | 10/1995 | Peachey | 210/512.2 |
| 5,730,871 A | | 3/1998 | Kennedy et al. | 210/512.2 |
| 5,996,690 A | * | 12/1999 | Shaw et al. | 166/250.01 |

FOREIGN PATENT DOCUMENTS

WO 96/30625 10/1996

* cited by examiner

*Primary Examiner*—Heather Shackelford
*Assistant Examiner*—Sunil Singh
(74) *Attorney, Agent, or Firm*—William L. Wang; William B. Batzer; John J. Ryberg

(57) ABSTRACT

A method and apparatus for the separation of the water from the oil/gas in the well itself, down-hole, in which gravity is allowed to work on the mixture in a non-vertical section of the well, and then, using separated flow paths, the gravity-separated components pumped to the surface or into a subterranean discharge zone. Detectors are used to control the pumping so as to keep the unsettled/unseparated mixture away from the flow paths. Preferably the discharge zone is chosen to have a formation pressure which is lower than the pressure of the producing zone.

30 Claims, 5 Drawing Sheets

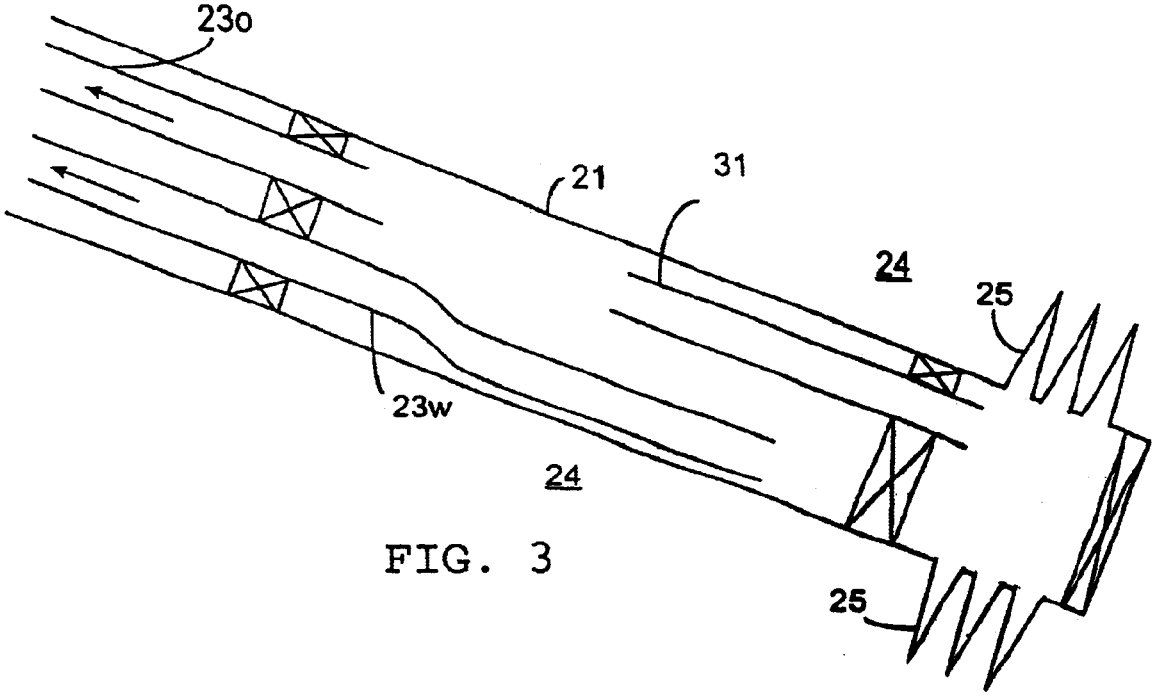
FIG. 3
FIG. 4A
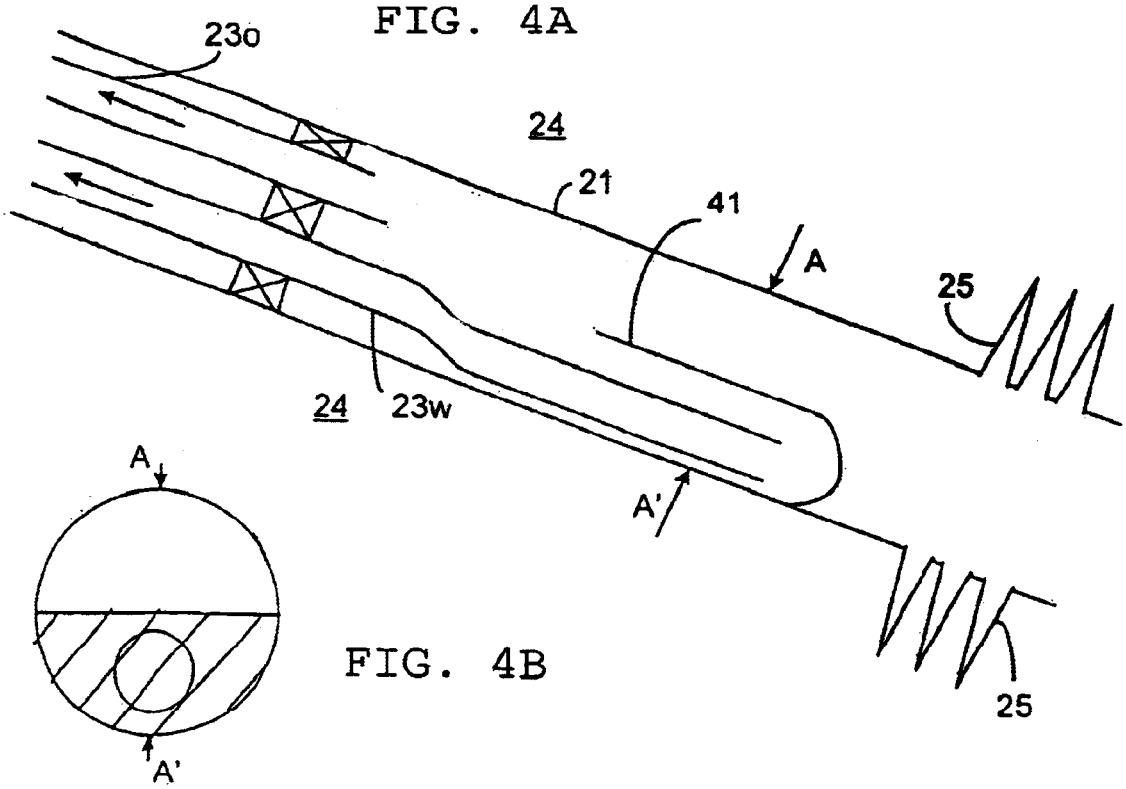
FIG. 4B

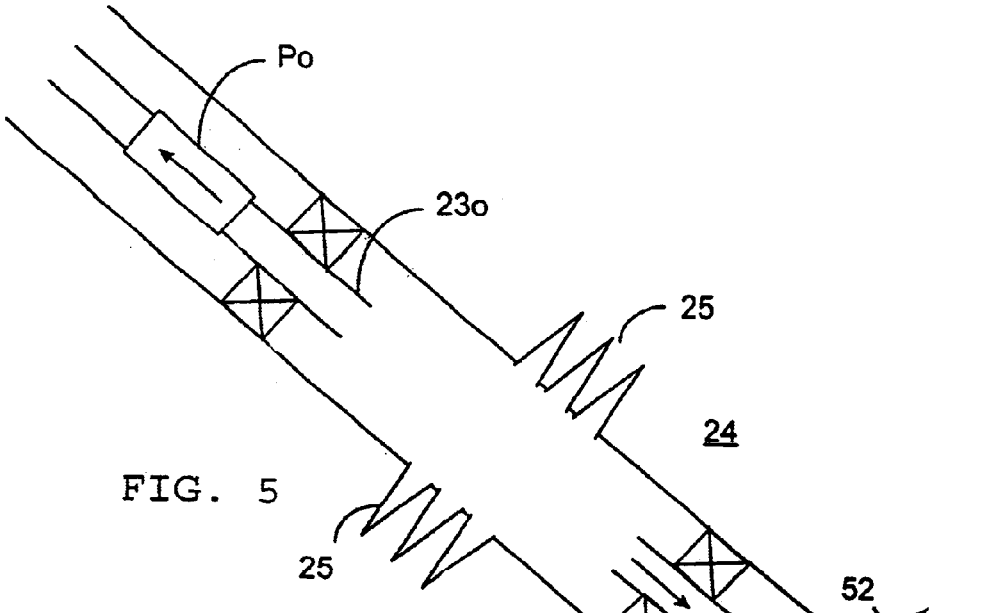
FIG. 5
FIG. 6A
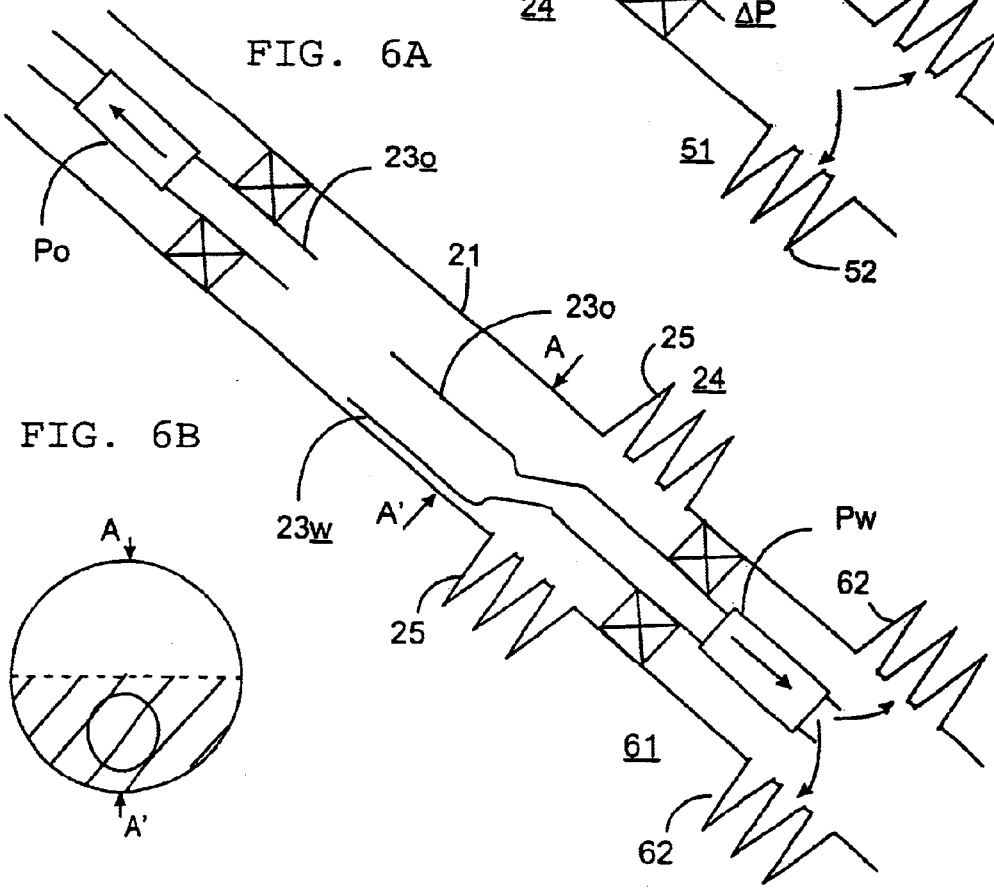
FIG. 6B

FIG. 9A
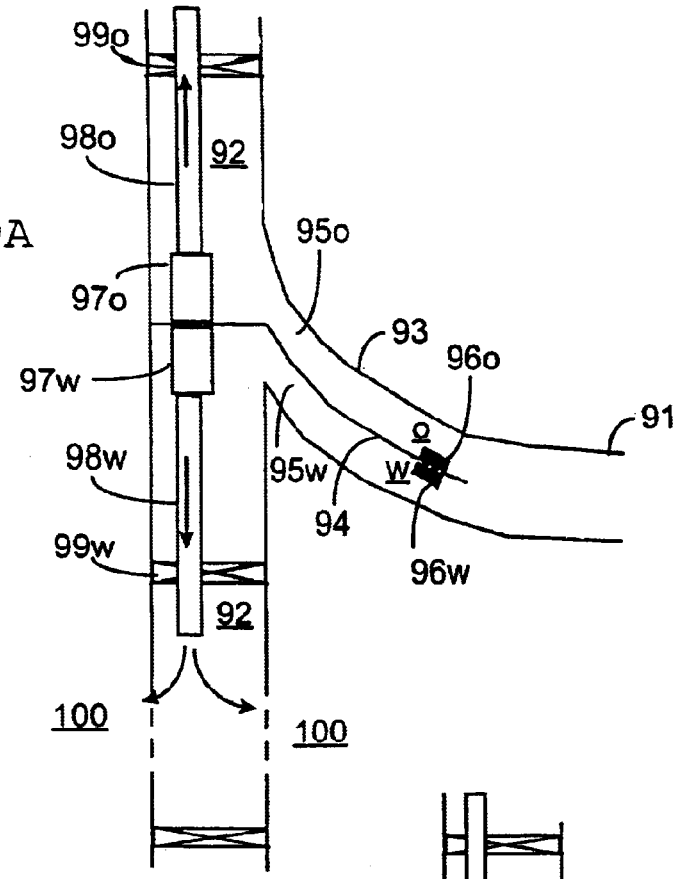
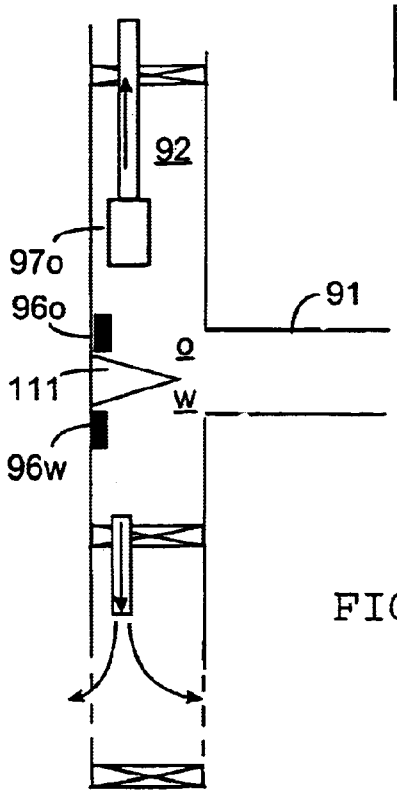
FIG. 9B
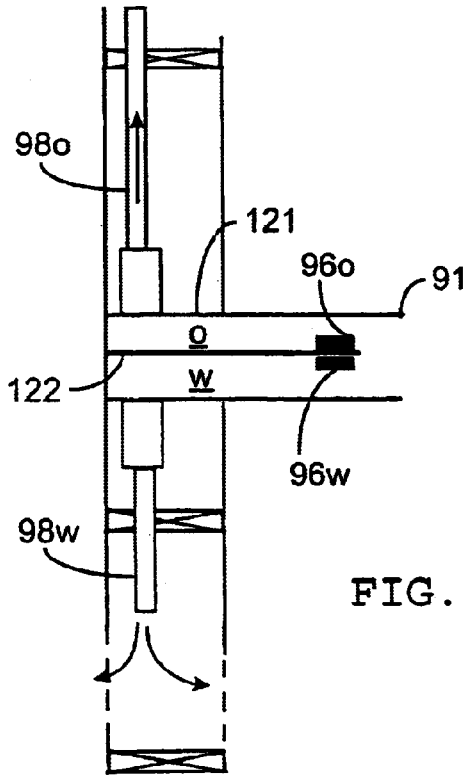
FIG. 9C

SEPARATION OF OIL-WELL FLUID MIXTURES

This invention relates to the separation of oil-well fluid mixtures, and concerns in particular the down-hole separation of the multi-phase oil/gas/water mixtures produced by an oil well.

BACKGROUND OF THE INVENTION

Most oil wells produce what is basically a mixture of oil and/or gas together with water (usually in the form of "brine", carrying quite large amounts of dissolved minerals, mostly common salt). Somewhere in the production process the ingredients have to be separated, the oil/gas to be stored and then delivered to a refinery for subsequent treatment, the water to be disposed of (often by pumping it back into the ground, perhaps in some borehole neighbouring the one it was removed from so as to replace the liquid removed from the formation, and maintain the associated pressure). For the most part this separation takes place above ground, and once the oil/gas/water mixture has been pumped up to the surface, but there are a number of good reasons why it would be highly advantageous—regardless of what actually then happens to the water—to effect the separation down-hole, even near the very earth formation out of which it has flowed into the borehole. Specifically, down-hole separation could result in a lighter liquid column within the borehole, it could permit a reduction in the separation equipment on surface, and it could facilitate the possibility of re-injecting the water directly down-hole, back into the formation (or a neighboring one) from which it originated. Other benefits of down-hole separation could be the easier separation before the mixture emulsifies, a reduced build-up of scale and corrosion, a minimizing of the risks from hydrogensulphide (a toxic gas often found in solution in oil well fluids), and a reduction in operating costs by reducing intervention in the well.

SUMMARY OF THE INVENTION

The invention relates to a method, and apparatus, for the separation of the water from the oil/gas in the well itself, down-hole. As explained in more detail hereinafter, the invention involves the combination of two ideas: the use of a gravity separator, and the utilization of controlling sensors positioned down-hole which identify the fluid components and then regulate the system accordingly. It is expected that this combination could be incorporated into an intelligent completion, in which the separated water is re-injected, resulting in an essentially water-free producing well.

In essence, the invention concerns a method of (and apparatus for) separating down-hole the two main components of an oil- (or gas-)well fluid, namely the oil/gas and the water, in which gravity is allowed to work on the mixture in a deviated section of pipe (a section that is not vertical, and then using physical separator means—smaller pipes, baffles and the like—the gravity-separated components are lead to individual pumps that will bring them to the surface (or wherever: as noted, the water can be injected back into the formation). This is the gravity separator. The crucial point, though, is to organize the pumping correctly, so as to keep the unsettled/unseparated mixture away from the separator means "inlets", and this requires that there must be positioned downhole, right next to the inlets, sensors/detectors that can distinguish between the two components, and then cause the pumping rates to be modified so as to keep the mixture away from the inlets, and thus keep the inlet feeds "pure"—the one or the other component, not the mixture—or at least "purer" than the fluid actually issuing from the producing formation.

In one aspect, therefore, the invention provides a method of separating down-hole the main components (water and oil/gas) of a multi-phase oil- (or gas-)well fluid emanating from an underground formation into which a well has been drilled, in which method:

- in a deviated, non-vertical section of the borehole the fluid is allowed to separate under gravity, aided by the flow regime imposed by the deviation, into separate streams or layers each being one (or mostly one) of its main components;
- each stream is allowed to enter a conduit or pipe positioned to receive that stream only, and though which the component may be pumped away as required; and
- component detector means are situated close to the effective mouth of each conduit/pipe, and are operatively linked to the relevant pump to alter the pump rate in dependence upon the actual nature of the material reaching the mouth.

In a second aspect the invention provides apparatus for use in a method of separating down-hole the main components (water and oil/gas) of a multi-phase oil- (or gas-)well fluid emanating from an underground formation into which the well has been drilled, which apparatus comprises, for location in a deviated, non-vertical section of the borehole within which the fluid is allowed to separate under gravity, aided by the flow regime imposed by the deviation, into separate streams or layers each being one (or mostly one) of its main components:

- divider means by which the borehole is effectively divided into separate conduits or pipes each positioned to receive one respective fluid component stream only;
- pump means associated with each such conduit/pipe and by which the relevant component may be pumped away as required; and
- component detector means situated close to the effective mouth of each conduit/pipe, and operatively linked to the relevant pump to alter the pump rate in dependence upon the actual nature of the material reaching the mouth.

The invention concerns the down-hole separation of the main components of a multi-phase well fluid emanating from an underground formation into which the well has been drilled. These components will normally be oil and/or gas (the lighter) and water (the heavier). The proportions of oil/gas and water may vary very widely depending upon the field from which the oil/gas is coming. Indeed, the ratios vary widely not only between fields but also within a field—a range of likely ratios could be from 1:100 to 100:1 and still be valuable; the invention is useful for all of these.

Hereinafter the well fluid is for convenience referred to as though it were merely a two-phase oil/water mixture, resulting in two streams. This, it will be understood, is a handy simplification; in reality the fluid could be oil/water or gas/water, or even three-phase oil/gas/water (resulting in three streams).

In the first stage of the invention's method the oil/water mixture emanating from the formation is passed into a deviated—non-vertical—section of the borehole, and there the fluid is allowed to separate under gravity into two streams or layers each being one of its two main components. Oil being lighter than water, a mixture of the two will tend to separate if allowed to do so—if left alone, or moved only slowly—with the oil rising to the top. In a horizontal pipe (borehole) the mixture would thus stratify, forming two quite distinct layers each moving along with the other but not mixing, whereas in a pipe/borehole at an angle to the vertical—for example, at 45°—there will be a tendency for the oil to move up along the upper side of the pipe while the water moves up along the bottom side (it is even possible for the water to try to move down along the bottom side of the pipe). The slip velocity between the several components plays a significant role in determining what angles of deviation give the best practical separation for the purposes of the invention, and it has been found that in general an angle of 40° to 60° to the vertical seems most satisfactory.

In the deviated, non-vertical section of the borehole the fluid is allowed to separate under gravity into two streams or layers each being one of its two main components. In a horizontal section it is evident that given the chance the fluid will stratify, the oil and water separating due to their differences in density, but—and perhaps surprisingly—even in an angled section gravity can be used quite effectively to separate oil and water. In this type of separation the efficiency of the process is mainly controlled by the velocity of the fluids in the pipe and the slip velocity between the oil and the water. In classical design the oil bubbles rise freely in water at a slip velocity of about 10 cm/s. In angled deviated pipe sections, however, the process of separation can be accelerated; the peculiar velocity and oil concentration profile observed—a high velocity and high oil concentration at the top of the section and a low or even negative velocity and low oil concentration at the bottom—results in a much higher effective slip velocity between the oil and water (up to 80 cm/s) which increases with the deviation and reaches a maximum between 60° and 80° degrees. FIG. 1 of the accompanying Drawings (discussed further hereinafter) gives diagrams to illustrate the velocity and hold-up profiles of a multi-phase deviated flow. Various equations can be used to describe hold-up profiles, but for present purposes it is merely necessary to understand qualitatively that the water hold-up is higher at the lower side of the pipe.

In the invention the fluid is allowed to separate under gravity into two streams or layers each consisting predominantly of one of the fluid's two main components (oil and water), and each stream is allowed to enter a conduit or pipe positioned to receive that stream only, and though which the relevant component may be pumped away as required. At its conceptually simplest the borehole above the separation point could be divided, by a partition wall roughly co-planar with its long axis, into two parts stretching the length of the hole, the wall being so orientated in the deviated section that one part is an "upper" part and the other a "lower" part. Clearly, if the oil/water mixture has been allowed to separate into two corresponding layers—an upper, oil layer and a lower, water layer—then, assuming a reasonable alignment, as the fluid is pumped out the upper, oil layer will enter and be pumped out through the upper part while the lower, water layer will enter and be guided through the lower part. There are many ways—many configurations—in which this division of the borehole pipe into parts can usefully be achieved in practice, and a number are shown in and briefly discussed hereinafter with reference to the accompanying Drawings. One basic possibility is to have two separate pipes within the borehole, one (picking up the oil) above the other (picking up the water). Another is not to divide any one length of borehole into two "parallel" conduits but instead to divide the borehole into two serially-linked portions, with the stratified fluid entering at the division point and part going on up the borehole and the rest going on down the borehole (as discussed further hereinafter with reference to FIG. 9B of the accompanying Drawings). Instead of a partition, there may be employed a deflector to assist in this separation.

Each stream is allowed to enter a conduit or pipe positioned to receive that stream only, and though which the relevant component may be pumped away as required. The oil, of course, will be pumped up to the surface. The water may also be pumped to the surface, or it may be re-injected into the formations through which the borehole passes. Preferably the water is guided into a formation having a lower pressure than the producing formation. This low pressure formation can be a formation depleted in a previous production cycle. If the pressure differential between low pressure formation and the producing formation is sufficiently high, the water flow can be discharged without using a (second) pumping device. Of course, this aspect of the invention has considerable advantages as it reduces the number of downhole pumps or, at least, reduces the load on the pump.

Some examples of this latter are shown in and briefly discussed hereinafter with reference to the accompanying Drawings.

As is noted above, the crucial necessity in effecting the invention is to ensure not only that the oil well oil/water fluid mixture is allowed to separate under gravity into two streams or layers each being predominantly one of its two main components, but also that each stream is allowed to enter a conduit or pipe positioned to receive that stream only. This latter effect—each stream being allowed to enter the appropriate conduit—depends very much on the rate at which the oil well fluid is being pumped (and in particular on the relative rates of each separated component), for the faster it is pumped the less time it has to separate out, and the more likely it is that the fluid that reaches the inlet to/mouth of the conduit is not a single, separated components but is still a mixture. Of course, if the fluid is pumped much more slowly then the well simply doesn't produce enough, and is inefficient. It is therefore important to monitor the situation, and optimally adjust the pumping speed to produce oil as fast as possible while still permitting adequate separation and not allowing a mixture to reach the conduit inlets.

This might seem a simple matter; observe what reaches the surface, and adjust the pumping rates accordingly. It is not simple, however, for under the ambient conditions a well constantly varies the rate at which it produces, and since the production zone in the well is likely to be several miles below ground, at such a distance, and with the time delay that it represents (as an example, at a speed of 1 m/s it may take as long as 30 minutes for well fluid to reach the surface), it is plainly not possible accurately to control the pumping rates so as to keep the feed to the conduits' inlets a single component rather than an unseparated mixture. It is therefore essential to incorporate the pump-controlling sensor/detector equipment downhole, adjacent the inlets themselves. And thus oil-fluid-component detector means are situated close to the effective mouth of each conduit/pipe, and are operatively linked to the relevant pump to alter the pump rate in dependence upon the actual nature of the material reaching the mouth.

The detectors need to be placed close to—and preferably just inside—the conduits/pipes along which the fluid components are to be pumped away. In the case (discussed further hereinafter with reference to FIG. 9B) where the conduits are two opposed portions of borehole with a "deflector" separating them, the detectors should be adjacent the deflector.

The detectors utilized for this purpose may be any appropriate to the task, i.e., detectors that work well under the extreme conditions of temperature and pressure 20,000 ft(about 5 miles, or 4 kilometer) down an oil well borehole. One suitable type of detector is that known as a gradiomanometer, which with associated pressure gauges can detect the density of the liquid (and thus distinguish between the lighter oil and the heavier water). The measurements made using such detectors are an average of the density in a relatively long section of tubing, becoming even longer in highly deviated wells.

Another type of detector is the X-ray densitometer, wherein an X-ray source and a detector are placed at opposite sides of a section of pipe, and the attenuation of the radiation is used to calculate the density of the fluid in the pipe. A similar physical configuration of detector can be applied using an optical source and a photo-detector. Yet other varieties of detector may be suitable, including electromagnetic and ultrasonic detectors and impedance measurers.

Several embodiments of the invention are now described, though by way of illustration only, with reference to the accompanying schematic (and not to scale) Drawings.

BRIEF DESCRIPTION OF THE DRAWINGS

FIG. 3 shows a dual completion gravity down-hole separator with the producing zone at the bottom of the hole;

FIGS. 4A and 4B are cross-section of a gravity separator using a baffled lower side section;

FIG. 5 shows a simple gravity down-hole separator with re-injection of water into the formation;

FIGS 6A and 6B are cross-section of a gravity separator using a baffled lower side section with water re-injection into the formation;

FIGS. 9A–C show three other embodiments of down-hole separators of the invention.

DETAILED DESCRIPTION OF THE PREFERRED EMBODIMENTS

As explained above, the velocity profiles of oil-water deviated flows are found to follow the relation:

$$v(z_D) = -6V_m\left(z_D^2 - \frac{1}{4}\right) + z_D(\sin\theta\cos\theta)^{1/2} - 2CD(\sin\theta)^2 z_D\left(z_D^2 - \frac{1}{4}\right), \quad [1]$$

where D is the pipe diameter, $V_m$ is the average velocity, t the inclination from horizontal, C is a constant, and $z_D$ is z/D is the normalized z coordinate.

Figure 1:
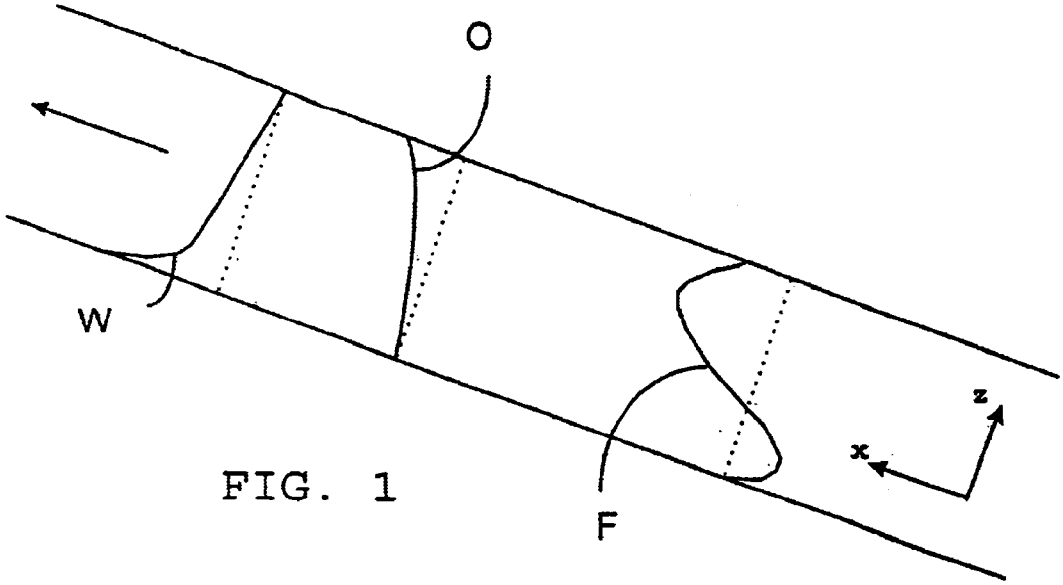
FIG. 1 is a diagram of the velocity profile of a multi-phase deviated flow.

FIG. 1 illustrates the meaning of this equation in practice, showing graphically the velocity and hold-up profiles of a multi-phase deviated flow. Depicted across the pipe, Curve W represents the water volume fraction profile, Curve O the oil volume fraction profile, and Curve F the fluid velocity profile. There are also model equations to describe hold-up profiles, but it can be easily understood that the water hold-up is higher at the lower side of the pipe.

Figure 2:
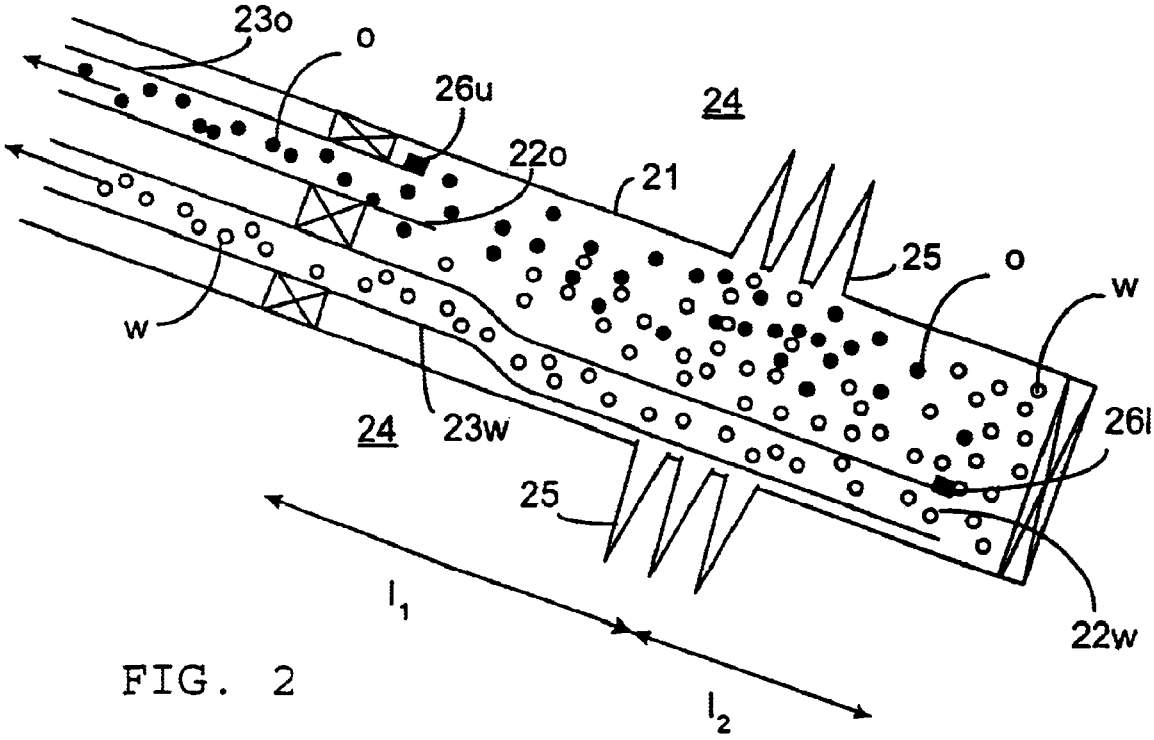
FIG. 2 shows a dual completion gravity down-hole separator of the invention.

A very simple separator, as shown in FIG. 2, can be made that will take advantage of this behavior. It is basically no more than a deviated pipe 21 of length $l=l_1+l_2$ fed at the middle by the mixture, the two phase outlets being at the two ends (upper and lower) of the pipe 21. One such outlet 22*o* is the inlet mouth of an internal conduit 23*o* positioned at the top end of the pipe 21, while the other 22*w* is the inlet mouth of a second internal conduit 23*w* positioned extending right down to the bottom end of the pipe 21. These conduits are to carry the oil and water respectively up to the surface (or to some other place, as required).

As will be apparent, a mixture of oil (the black circles; o) and water (the white circles; w) seeps out of the oil-producing formation 24 through which the pipe 21 passes through perforations 25 in the formation and the borehole casing (not separately shown) into the borehole itself. There it exists first as a mixture, in a mixture zone, but gradually it begins to separate under gravity into two parts, the lighter, oil part tending to rise to the upper side of the deviated pipe 21, the heavier, water part tending to sink to the lower side. Eventually, and over the length $l_1$ of the pipe, the upper part of the pipe is full of oil(black circles; o), with little or no water, while the lower part is full of water (white circles; w), with little or no oil.

It will be seen, then, that the inlet mouth 22*o* of the upper conduit 23*o* is immersed in oil alone, while the inlet mouth 22*w* of the lower conduit 23*w* is immersed in water alone. Accordingly, if the borehole's contents are then extracted—by a combination of the pressure of the fluid seeping out of the formation and pumps (not shown) associated with each conduit 23—effectively oil alone will be pumped out along the upper conduit 23*o* while effectively water alone will flow out along conduit 23*w*.

Of course, if the oil extraction rate is too high relative to the water extraction rate then as fluid is pumped out so the oil/water mixture has less and less time in the deviated section to separate under gravity and the imposed flow conditions, and the mixture zone adjacent the perforations 25 tends to extend up until it reaches the inlet mouth 22*o* of the upper conduit 23*o*, at which point the fluid entering (and being pumped up) that conduit is no longer oil alone but has become an oil/water mixture. Similarly, if the water extraction rate is too high, then the oil/water mixture zone expands to extend down to the inlet mouth 22*w* of the bottom conduit 23*w*, and a mixture of water and oil is pumped away instead of water alone.

The invention deals with this problem by incorporating detectors (26*u,l*) at the mouths 22*w,o* of each conduit 23, which detectors can distinguish between oil (or water) and oil and water, and then using the output of the detectors to control the rate at which the pumps actually pump. Suitable detectors 26 for the anticipated location are for example gradiomanometers comprising two absolute pressure gauges or a fluid identification system based upon the attenuation of a signal transmitted through/across the pipe 23 between a transmitter and receiver. The signal may take any form—ultrasound, or low-frequency electromagnetic radiation (radio waves) or higher frequency radiation (light or gamma waves)—suitable for the fluids being detected, and calibrated against known examples of those fluids to provide a database of signal outputs to be expected.

Thus, if the mixture zone extends up to the upper conduit 23*o* (because the associated oil pump is pumping too fast), the upper detector 26*u* detects this and sends a suitable signal to the pump (not shown) for that conduit to slow it down, thus allowing the zone to retreat back down the pipe 21, and so keep the feed to the conduit 23*o* made of oil alone. And in the same way, if the mixture zone extends down to the lower conduit 23*w* (because the associated water is pumped too fast), the lower detector 26*l* detects this and sends a suitable signal to the pump (not shown) for that conduit to slow it down, thus allowing the zone to retreat back up the pipe 21, and so keep the feed to the conduit 23*w* made of water alone.

Several physical configurations of the separation system of the invention are possible, and some of these are now described in more detail.

FIG. 3 shows a different form of dual completion that could be used to separate the fluids and to bring them to surface. In this configuration the borehole does not extend beyond the producing zone 24,25 and to provide a space for the water a length of internal conduit 31 is positioned just above that zone. In this case, the mixture of oil and water leaving the formation passes up the conduit 31, and then separates out. The oil passes on up the main oil conduit 23*o*, while the water flows down into the water space volume alongside conduit 31, and is then pumped away through the water conduit 23*w*.

FIGS. 4A–B shows a slightly different but nevertheless very similar configuration for doing the same. Here the bottom of the water conduit 23*w* is enclosed within an open-topped compartment 41; in operation the oil/water mixture emanating from the formation flows up the pipe 21 separating under gravity as it does so, and while the oil passes further up, along the oil conduit 23*o*, the water flows back down into the lower compartment 41, from which it is pumped away up conduit 23*w*. A second cross section perpendicular to the pipe 21 is also shown.

FIGS. 5 and 6A–6B show configurations in which the separated water might be directed or injected back into the formations through which the borehole passes.

In FIG. 5 the oil/water mixture from the producing zone 24 and perforations 25 separates into an oil portion (which is pumped away up the oil conduit 23*o*) and a water portion which is pumped away through water conduit 23*w* not up to the surface but down into a lower injection or discharge zone 51 (with perforations 52), where it is forced back into the formation around the borehole. In this example it is assumed that the discharge zone 51 has a lower pressure than the producing layer 24. A previously producing but now depleted zone could for example be used as discharge zone. It is further assumed that the pressure differential DP between zones 24 and 51 suffices to generate and sustain a flow into the discharge formation. To produce the oil, however, a pump Po is employed.

In FIG. 6 much the same happens in a configuration that is more like that of FIG. 3. The oil/water mixture from producing zone 24 separates as it passes up pipe 21 into an oil portion, which is pumped away up conduit 23*o*, and a water portion, which is pumped away down conduit 23*w* (shown in cross section in the smaller sub-Figure) and re-injected back into a lower injection zone 61 through the perforations 62. In contrast to the configuration of FIG. 5, here the pressure differential between the producing layer 24 and the discharge layer 61 is assumed to be too small to avoid the use of a second pump Pw.

Figure 7:
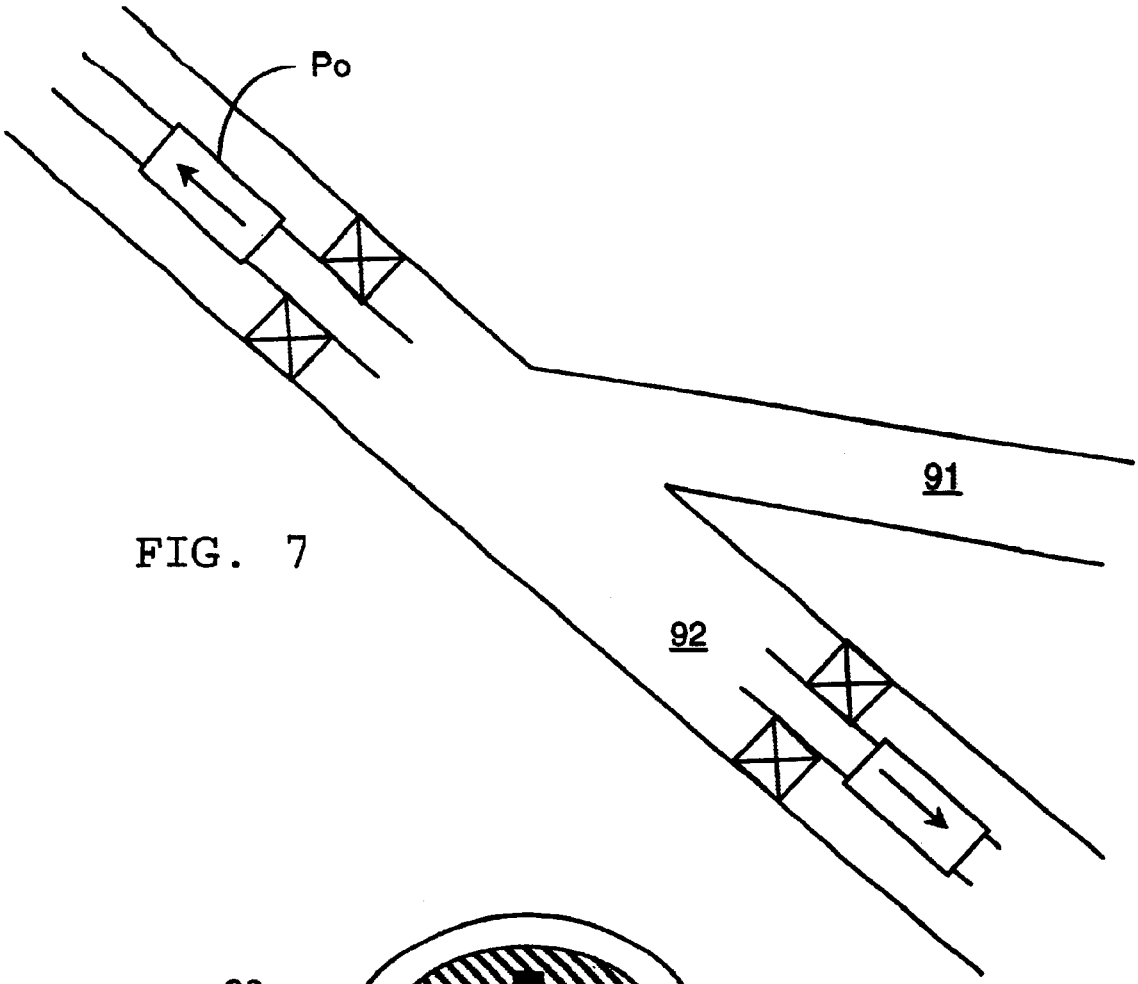
FIG. 7 shows a gravity down-hole separator using multilateral branches for re-injection of water into the formation.

FIG. 7 demonstrates a possibility when the well is a multilateral well. An oil/water mixture emanating from a producing zone (not shown) in one—the upper—branch 91 of the well could separate out just above a second—the lower—branch 92, into which the water could then be pumped to be re-injected somewhere down that branch.

Figure 8A:
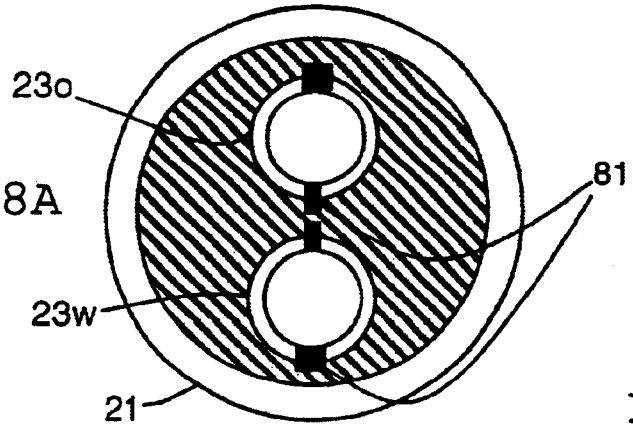
FIGS 8A and 8B are cross-section of a dual tubing completion with a fluid identification system for separation in horizontal wells with stratified flows.
Figure 8B:
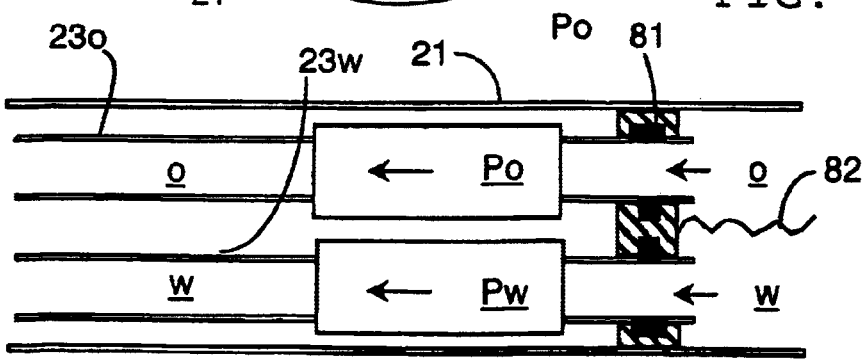

Although the invention seems to work best when in a section of well bore deviated to around 40° to 60° nevertheless the invention can be applied to horizontal deviated well bores at an angle of 40 to 90 degrees to the vertical. FIGS. 8A and 8B shows this (8A in a vertical plane cross-section normal to the bore axis, 8B in a vertical plane parallel to the axis). Like reference numerals are used to denote like elements to those in the previous figures. In such a configuration it could be very difficult to achieve good separation, even with the use of hold-up meters 81 at the end of each tubing 23, as the interface level 82 separating water and oil fluctuates rapidly. However, it may be enough to reduce the water cut in marginally profitable wells.

To achieve consistent separation each component conduit 23 is associated with a detector 81 at its inlet mouth that can sense when the fluid is either only oil, or only water, or a mixture. The detector shown is of the attenuation type with a source element and a receiver at diametrically opposed locations.

FIGS. 9 A,B and C show three other embodiments of downhole separator of the invention. Again, the principle of gravity separation is used to reduce the water content of the produced fluid. However, the following embodiments describe the invention in cases where a essentially horizontal oil-producing section 91 of the well leads into an essentially vertical section 92 of the same well.

In the roughly horizontal section 91, the fluid has been allowed to separate into two distinct stratified flows—oil o on top of water w—and at an angled section 93 of the borehole, by which the oil-producing section 91 joins a substantially vertical portion 92 of the borehole, the borehole is divided into two by a rigid baffle 94 and these stratified flows are fed one each to the two corresponding conduits 95*o*, 95*w* defined by the baffle.

Just within the baffled portion, just upstream of the entrance thereto, each conduit contains a detector 96*o*, 96*w* that can output a signal defining the nature of the fluid—oil, water or a mixture of the two—in the conduit. These signals are used to control (by means not shown) the operation of one or two pumps 97*o*, 97*w* that then drive the oil and water on. In this particular embodiment, pump 97*o* drives the oil component on up the borehole along an internal pipeline 98*o* that extends through a packer 99*o* that separates the upper reaches of the borehole from those below, while pump 97*w* drives the water component down along pipeline 98*w* and past a packer 99*w* that separates this part of the borehole from that below. The water is injected into a depleted formation 100 into which the lower section of the borehole 92 passes.

In the embodiment of FIG. 9B there is shown a borehole wherein a horizontal section 91 is joined directly to a vertical section 92 without any intermediate angled section. In this embodiment there is no baffle, merely a wedge-shaped deflector 111 that assists in "dividing" the stratified fluid o, w into two streams one heading up the borehole to pump 97*o* and the other heading down into a depleted formation driven by a pressure differential between the producing formation and the discharge formation. The two detectors 96*o*, 96*w* control the operation of pump 97*o*. In this embodiment there are no conduit/pipes along which the separated fluid components are pumped other than the two opposed sections of the borehole, one going up, the other going down.

A slightly different version of the FIG. 9B embodiment is shown in FIG. 9C. Here there is also a horizontal borehole section 91 connected directly to a vertical section 92, but the connection is made using a conduit 121 having an internal baffle 122 dividing it to match the two fluid component strata o, w. The detectors 96*o*, 96*w* are positioned within the respective parts of the conduit 121, and again control the pumps 97*o*, 97*w* (by means not shown) so as to pump oil up along pipeline 98*o* and water down along pipeline 98*w*.

What is claimed is:

1. A method of producing fluid containing hydrocarbons and water from a subterranean formation, said method comprising the steps of:

providing at least two separate flow paths each having an opening to the flow of the fluid within a non-vertical section of a well having an angle of 40 to 90 degrees to the vertical and forming a gravity separator, said openings being vertically separated;

placing at least one detector in the vicinity of at least one of said openings;

allowing gravity to separate the fluid flow through said gravity separator into an hydrocarbon enriched part and a water enriched part;

controlling the flow of said hydrocarbon enriched part through the upper of said vertically separated openings using flow controlling equipment; and using measurements of said at least one detector to control said flow controlling equipment.

2. The method of claim 1 wherein a first of the at least two separated flow paths is directed to the surface and a second of said at least two separated flow paths is directed into a subterranean discharge formation.

3. The method of claim 2 wherein the discharge formation has a lower pressure than the producing formation.

4. The method of claim 3 wherein pumping into the discharge formation is exclusively based on a pressure difference between the discharge formation and the producing formation.

5. The method of claim 1 wherein the non-vertical section is at an angle of 40 to 60 degrees to the vertical.

6. The method of claim 1, having a detector associated with each separated flow paths.

7. The method of claim 1 comprising the step of positioning the at least one detector within the flow path of the water enriched part.

8. The method of claim 1 wherein the step of controlling the flow comprises pumping using pumping equipment positioned in the flow direction after said gravity separator.

9. An apparatus for producing fluid containing hydrocarbons and water from a subterranean formation, said apparatus comprising:

at least two separate flow paths each having an opening to the flow of the fluid within a non-vertical section of a well having an angle of 40 to 90 degrees to the vertical and forming a gravity separator, said openings being vertically separated with a first of said openings being placed in a hydrocarbon enriched part of said fluid and a second of said openings being placed in a water enriched part of said fluid;

at least one detector in the vicinity of at least one of said openings;

a flow control device being operationally controlled by said at least one detector, said flow control device being positioned in flow direction after said gravity separator.

10. The apparatus of claim 9 wherein the at least two separate flow paths include a wedge, a baffle, or a pipe as boundary.

11. The apparatus of claim 9 wherein a first of the at least two separated flow paths connects to the surface and a second of said at least two separated flow paths connects to a subterranean discharge formation.

12. The apparatus of claim 11 wherein the subterranean discharge formation has a lower pressure than the producing formation.

13. The apparatus of claim 9 having a detector associated with each separate flow path.

14. The apparatus of claim 9 wherein the non-vertical section of the well forming the gravity separator is inclined by an angle of 40 to 60 degrees to the vertical.

15. The apparatus of claim 9 wherein the at least one detector is positioned within the flow path of the water enriched part.

16. The apparatus of claim 9 wherein the flow control device comprises at least one pump.

17. A method of producing fluid containing hydrocarbons and water from a subterranean formation, said method comprising the steps of:

providing at least two separate flow paths each having an opening to the flow of the fluid within a non-vertical section of a well having an angle of 40 to 90 degrees to the vertical and forming a gravity separator, said openings being vertically separated;

placing at least one detector in the vicinity of at least one of said openings;

allowing gravity to separate the fluid flow through said gravity separator into an hydrocarbon enriched part and a water enriched part;

pumping said hydrocarbon enriched part through the upper of said vertically separated openings and said water enriched part through the lower of said vertically separated openings using pumping equipment positioned in flow direction after said gravity separator; and using measurements of said at least one detector to control said pumping equipment.

18. The method of claim 17 wherein a first of the at least two separated flow paths is directed to the surface and a second of said at least two separated flow paths is directed into a subterranean discharge formation.

19. The method of claim 18 wherein the discharge formation has a lower pressure than the producing formation.

20. The method of claim 19 wherein pumping into the discharge formation is exclusively based on a pressure difference between the discharge formation and the producing formation.

21. The method of claim 17 wherein the non-vertical section is at an angle of 40 to 60 degrees to the vertical.

22. The method of claim 17, having a detector associated with each separated flow paths.

23. The method of claim 17 comprising the step of positioning the at least one detector within the flow path of the water enriched part.

24. An apparatus for producing fluid containing hydrocarbons and water from a subterranean formation, said apparatus comprising:

at least two separate flow paths having openings to the flow of the fluid within a non-vertical section of a well having an angle of 40 to 90 degrees to the vertical and forming a gravity separator, said openings being vertically separated with a first of said openings being placed in a hydrocarbon enriched part of said fluid and a second of said openings being placed in a water enriched part of said fluid;

at least one detector in the vicinity of said openings;

at least one pump being operationally controlled by said at least one detector, said pump being positioned in flow direction after said gravity separator.

25. The apparatus of claim 24 wherein the at least two separate flow paths include a wedge, a baffle, or a pipe as boundary.

26. The apparatus of claim 24 wherein a first of the at least two separated flow paths connects to the surface and a second of said at least two separated flow paths connects to a subterranean discharge formation.

27. The apparatus of claim 26 wherein the subterranean discharge formation has a lower pressure than the producing formation.

28. The apparatus of claim 24 having a detector associated with each separate flow path.

29. The apparatus of claim 24 wherein the non-vertical section of the well forming the gravity separator is inclined by an angle of 40 to 60 degrees to the vertical.

30. The apparatus of claim 24 wherein the at least one detector is positioned within the flow path of the water enriched part.

* * * * *